United States Patent [19]

Esposito, Jr. et al.

[11] 4,164,968

[45] Aug. 21, 1979

[54] PORTABLE TENNIS LOCKER ORGANIZER

[76] Inventors: Joseph Esposito, Jr.; Andrew Peluso, Jr., both of 318 A St., Middlesex, N.J. 08846

[21] Appl. No.: 872,570

[22] Filed: Jan. 26, 1978

[51] Int. Cl.[2] ..... B65D 65/02

[52] U.S. Cl. ..... 150/1; 150/52 G

[58] Field of Search ..... 150/1, 12, 28 R, 33, 150/34, 52 G

[56] References Cited

U.S. PATENT DOCUMENTS

| | | | |
|---|---|---|---|
| D. 231,807 | 6/1974 | Berry | 150/52 G |
| 1,541,895 | 6/1925 | Blair | 206/14 |
| 3,963,103 | 6/1976 | Cowen | 150/52 G |
| 4,023,800 | 5/1977 | Haggerty | 150/52 G |

*Primary Examiner*—R. E. Hart

[57] ABSTRACT

A portable tennis locker organizer which comprises in combination (a) foldable bag-like member which exposes in its unfolded position and on its interior surface; (b) a plurality of pouches and pocket compartments permanently affixed to the interior surface of said bag-like member; (c) a half moon shaped pocket with strap fastening means that is also permanently affixed to the interior surface of said bag-like means and positioned so that a tennis racket placed within said pocket will lie in a plane horizontally with respect to the vertical plane of said bag-like member in its unfolded position; (d) a cylindrical sleeve pocket contained within the interior surface of the bag-like means and of sufficient size and located opposite the half moon shape pocket so that the handle of a tennis racket may be inserted therein while the racket's head is contained within the half moon pocket.

Also described and contained within the interior surface of the bag-like means is a number of pocket enclosures containing zipper closure means affixed adjacent to the cylindrical sleeve pocket and of a sufficient size to hold tennis sneakers and the like. The bag in its unfolded position will have hanging means attached to the top portion of the bag whereby the bag can be hung while in its unfolded position from structures such as fences or nets.

6 Claims, 3 Drawing Figures

PORTABLE TENNIS LOCKER ORGANIZER

BACKGROUND OF INVENTION

Combined carrying cases for transporting clothing and equipment of rackets sports are generally well known. Examples of such constructions may be found in Hanes U.S. Pat. No. 2,767,758, and Glantz et al, U.S. Pat. No. Des. 223,424, Haggerty, U.S. Pat. No. 4,023,800, Berry et al, U.S. Pat. No. Des. 231,807, Cowan, U.S. Pat. No. 3,939,631 and Blair, U.S. Pat. No. 1,541,895. Most of the above referred to patents describe various types of cases for holding in various limited fashions a racket and a can of balls. In another a fold up bag which has one compartment with a zipper for storage of clothing items and a sleeve to contain a cannister ball and a zippered pouch to contain the racket itself is described. Other patented devices are simply a combined carrying bag and racket carrier where the racket is carried in a sleeve outside of the bag and the bag itself has various compartments to contain shoes and other items useful in the racket sports.

None of the prior art devices, however, desribe a carry-all case which contains various compartments, pockets which are necessary to carry all of the accessories for racket sports in which in its unfolded position will provide the tennis player with easy access to all of the items carried; such a bag has not been previously fabricated. To be very useful a bag should provide ease and facility in use and ease in which the bag in its fold-up position can be carried from the court to the car and likewise. Such a bag which additionally has an interior design of compartments and pouches to provide an equivalent weight distribution for ease of handling in which in its unfolded position can be secured to particular anchor type fences found in outdoor tennis courts would be very advantageous in providing the player with all of the necessary items for the game of tennis at eye level.

SUMMARY OF INVENTION

In accordance with the present invention, therefore, a novel and improved portable tennis locker organizer is provided comprising in combination:

(a) a foldable bag-like member;

(b) a plurality of pouches permanently affixed to the interior surface of said bag-like member;

(c) a plurality of pocket compartments affixed in similar fashion;

(d) a half moon shaped pocket with strap fastening means permanently affixed to the interior surface of said bag-like means and positioned so that a tennis racket placed within said pocket will lie in a plane horizontally with respect to the vertical plane of said bag-like member in its unfolded position;

(e) cylindrical sleeve pocket affixed to said bag-like member's interior surface and located in juxtaposition to the pocket described in (d) above whereby the handle of a tennis racket may be inserted therein while said racket's head is contained within pocket (d);

(f) a plurality of pocket enclosures containing closure means affixed adjacent to said cylindrical sleeve pocket to contain shoe items and the like;

(g) a plurality of hanging means attached to one end of said bag-like means whereby said bag-like means can be hung, while in its unfolded position, from structures such as fences;

(h) a fastening means attached to exterior ends of said bag-like means to permit securing said bag-like means in a folded position for ease of carrying in transportation.

The novel design and combination of pockets, pouches and compartments within the interior of the bag-like means provides for the transportation of all of the items necessary for the game of tennis and when it is unfolded and hung on an anchor fence normally found surrounding outside tennis courts or netting as found on inside tennis courts provides eye level access to all of the various compartments, pouches and pockets that contain the accesssories necessary for the game of tennis.

The sizes of the pockets, compartments and pouches will be of adequate size and width to contain items such as Kleenex tissues, wallets, tennis togs, a can of tennis balls, a roll up towel holder which contains an inner plastic bag meant to carry a damp face cloth, a vanity case with mirror on its outside flap for clean up after the game and a number of zipper pockets for the carrying of tennis shoes and the like.

In accordance with the invention, the bag-like portable locker includes novel fastening means attached to exterior ends of the bag to permit securing the bag in the folded position. The closure means may be in the form of a double zipper, single zipper, friction tape and the like with the interior design and orientation of the compartments and pouches of the bag-like means provided to allow for facility in carrying and approximate equivalent weight distribution for ease of handling. In its folded position, the bag is approximately 13 inches in width. In its unfolded position, the bag may be approximately 3 foot in length and width.

The portable locker has, therefore, been designed with a two-fold purpose, one is to make convenient to the players all of the tennis gear needed for the game taken onto the court, indoors or outdoors and to have pockets designed specifically to accommodate articles of convenience, such as described above. Secondly, the design and construction of the portable locker in the way set forth in the drawings hereinafter described, makes it totally functional and convenient for both use on the court and in transportation to and from the court.

Each pocket, pouch and compartment has been included within the combination for designated specific purposes. Its convenience in use is due to the self-contained ease of access for the player to all or most articles at eye level. By attaching "S" hook means on the top portion of the bag, the bag can be hung on anchor fences and will give the convenience of eye level access. In its folded position, the bag is carried on the shoulder by a strap. In use, the person faces the anchor fence, removes the bag from the shoulder, holding the bag by the corners and hooks the bag onto the fence or indoor netting and thereafter unfolds the bag exposing said compartments, pockets and pouches, thus keeping the bag off the court floor, allowing time saving access to all of the various accessories needed for the game of tennis.

Material from which the bag and compartments can be constructed may be any coarse, dense fabric, such as heavy denim material. Other materials, however, useful in fabrication include leather, vinyl, cotton, polyester or blends of same depending upon the ultimate consumer's purchasing taste.

The invention will now be further described by reference to the enclosed drawings in which FIG. 1 illustrates a front view of the portable tennis locker organizer in its folded position;

Figure 3:
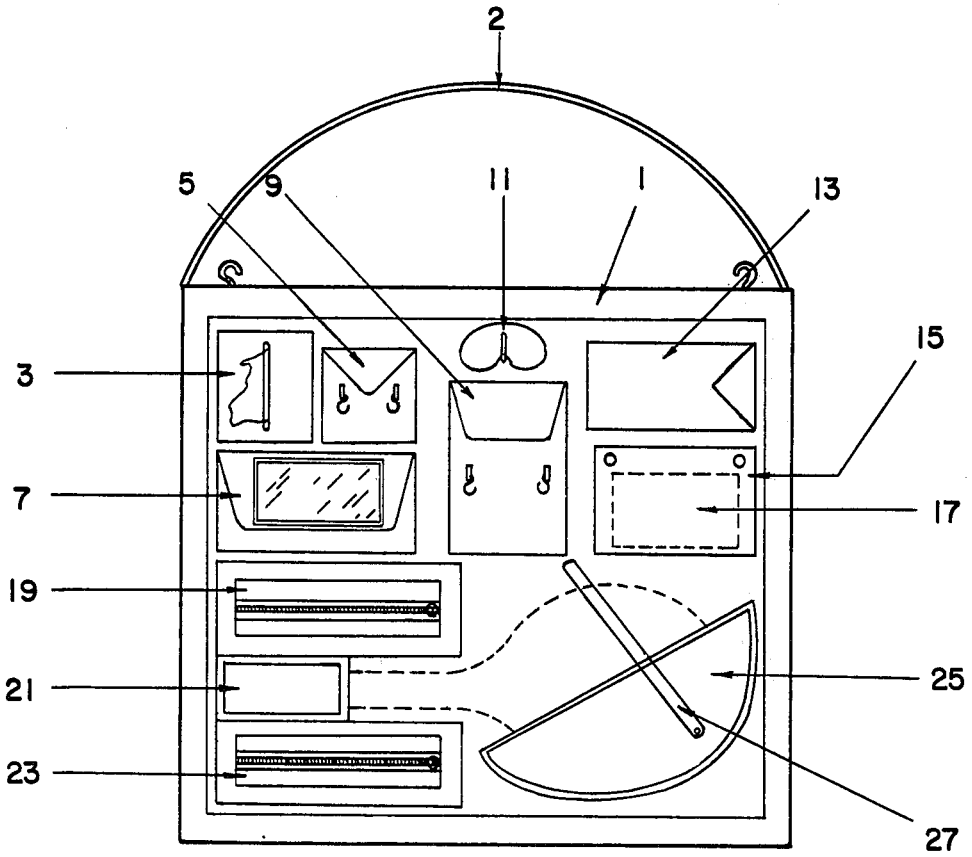
FIG. 3 is a front view of the portable tennis locker organizer in its unfolded position.

FIG. 3 illustrates the foldable bag-like member in its unfolded position, again illustrating carrying strap (2) in a variety of pockets, pouches and compartments in a specific orientation as illustrated where (3) is a pouch suitable in size to contain Kleenex type tissues; (5) is a compartment of suitable size to contain wallets and the like, having fastened to its outside surface "S" hook fasteners from which keys and the like could be attached; a utility bag, pocket (9) of sufficient size to contain warm-up togs and the like; eye glass or sun glass holder (11); a cylindrical sleeve (13) suitable in size to contain tennis ball cannister; (15) a roll-up towel holder which contains within it a plastic bag of suitable size (17) to hold face cloths and the like. Also illustrated in FIG. 3 is vanity case with mirror (7) a zippered sneaker pouch having depth, length and width to enable the player to carry additional pairs of sneakers. The racket is held in place by grip sleeve (21), half moon cradle (25) that has strap (27) attached. Another zippered pouch is shown illustrated (23), the lower left hand portion of the bag, to carry additional utensils useful in the racket sports. FIG. 3 also shows the "S" hook fastening devices suitably affixed to the rear surface of the unfolded bag and facilitating the player with a means for attaching the bag in its unfolded position to the anchor type fences found surrounding outdoor nets or interior netting that normally is employed in the indoor tennis courts.

While having illustrated and described certain preferred embodiments of the invention above, it is understood that the present invention is not limited to the precise constructions or illustrations as herein disclosed and that various changes and modifications may be made within the scope of the invention as defined in the appended claims.

Having thus described the invention what is claimed is:

1. A portable tennis locker-organizer comprising in combination:

(a) a foldable bag-like member;

(b) a plurality of pouches permanently affixed to the interior surface of said bag-like member;

(c) a plurality of pocket compartments affixed in similar fashion as (b) above;

(d) a half moon shape pocket with strap fastener means permanently affixed to the interior surfaces of said bag-like means and positioned whereby a tennis racket placed within said pocket will like in a plane horizontally with respect to the vertical plane of said bag-like member in its unfolded position;

(e) a cylindrical sleeve pocket affixed to said bag-like member's interior surface and located in juxtaposition to the pocket described in (b) above whereby the handle of a tennis racket may be inserted therein while said racket's head is contained within pocket (d);

(f) a plurality of pocket enclosures containing zipper closure means affixed adjacent to said cylindrical sleeve pocket;

(g) a plurality of hanging means attached to one end of bag-like means, whereby, said bag-like means can be hung while in its unfolded position from structures such as fences and the like;

(h) a fastening means attached to exterior ends of said bag-like means to permit securing said bag-like means in a folded position.

Figure 1:
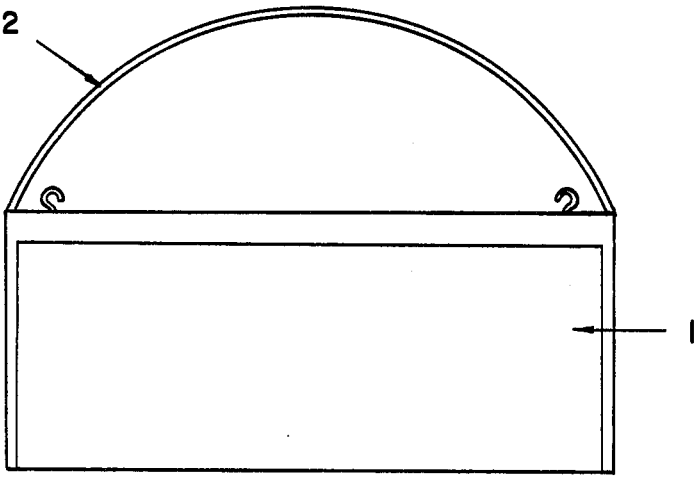
FIG. 1 shows the foldable bag-like member (1) in its folded front view position in which carrying strap (2) is illustrated as well as hanging means shown in the drawing as "S" hooks.
Figure 2:
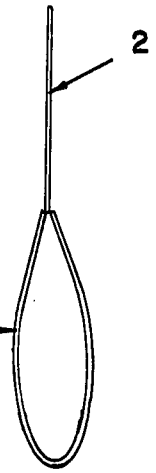
FIG. 2 is a side view of the folded portable tennis locker organizer.

2. The portable tennis locker organizer of claim 1 comprising an orientation of said pockets, compartments and pouches as illustrated in FIG. 1.

3. The portable tennis locker organizer of claim 1 wherein said foldable bag-like member is fabricated from heavy denim fabric.

4. The portable tennis locker organizer of claim 1 wherein said pocket compartments of (c) of a size sufficient to contain wallets, tennis togs and tennis ball cannister.

5. The portable tennis locker organizer of claim 1 which additionally contains "S" hook fasteners permanently affixed to the exterior surface of the foldable bag-like member and suitably located to provide a hanging means for the foldable bag-like member in its unfolded position.

6. The portable tennis locker organizer of claim 1 further characterized by a plurality of independent carrying means being provided on said foldable bag-like member including a hand grip and a shoulder strap, said shoulder strap being removably secured to the sides of said foldable bag-like member.

* * * * *